US006461209B2

(12) United States Patent
Evans

(10) Patent No.: US 6,461,209 B2
(45) Date of Patent: Oct. 8, 2002

(54) SWIM FIN HAVING ARTICULATED WING MEMBERS

(76) Inventor: Robert B. Evans, 715 Kimball Ave., Santa Barbara, CA (US) 93103

( * ) Notice: Subject to any disclaimer, the term of this patent is extended or adjusted under 35 U.S.C. 154(b) by 0 days.

(21) Appl. No.: 09/892,119

(22) Filed: Jun. 25, 2001

(65) Prior Publication Data

US 2001/0051477 A1 Dec. 13, 2001

Related U.S. Application Data

(62) Division of application No. 09/549,088, filed on Apr. 13, 2000.

(51) Int. Cl.[7] ..... A63B 31/08
(52) U.S. Cl. ..... 441/64
(58) Field of Search ..... 441/64; D21/806

(56) References Cited

U.S. PATENT DOCUMENTS

| | | | | | |
|---|---|---|---|---|---|
| 3,952,351 | A | * | 4/1976 | Gisbert | 441/64 |
| 4,767,118 | A | * | 8/1988 | Ostergard | 441/60 |
| 5,108,327 | A | * | 4/1992 | Klein | 441/62 |
| 5,417,599 | A | * | 5/1995 | Evans | 441/64 |
| 5,527,197 | A | | 6/1996 | Evans | 441/64 |
| 5,634,613 | A | | 6/1997 | McCarthy | 244/199 |
| 5,746,631 | A | | 5/1998 | McCarthy | 441/64 |
| D404,456 | S | | 1/1999 | Evans | D21/806 |
| 6,120,336 | A | * | 9/2000 | Kawai et al. | 441/64 |

* cited by examiner

*Primary Examiner*—S. Joseph Morano
*Assistant Examiner*—Andy Wright
(74) *Attorney, Agent, or Firm*—Cislo & Thomas LLP

(57) ABSTRACT

A swim fin has articulating wing members articulated by means of clock washers or the like with respect to a foot pocket to provide, among other things, adjustment of pitch and tension of such wing members or other fin blade. A swim fin with articulating wing members may have a foot pocket with a forked end. Articulating wing members may then be attached to the fork stubs, there being right and left articulating wing members. Clock washers or the like may serve to provide stable and adjustable means by which the disposition of the individual articulating wing members may be selectably disposed with respect to the foot pocket. Each of the articulating wing members extends away from the foot pocket, there possibly being a gap separating the individual articulating wing members. The ends of the wing members may be flared outwardly. The outermost side of the articulating wing members may also be flared upwardly. The gap between the wing members may serve to allow the flow of water through and past the articulating wing members. The swim fin of the present invention allows the swim kick to concentrate its energy in a more propulsive direction. An alternative embodiment of the present invention has individual webbed rails generally connected at their common base, but may be separated, or split, near their end. The rails are generally attached to the foot pocket in the manner similar to that for the articulating wing members. The optional separation between the webbing at the end of the fin allows the water to flow through and past the webbing. The flow through the separation prevents swim kick energy from being dispersed laterally and allows focus of the swim kick energy in a propulsive, rather than dispersive, direction.

5 Claims, 10 Drawing Sheets

SWIM FIN HAVING ARTICULATED WING MEMBERS

CROSS-REFERENCES TO RELATED APPLICATIONS

This application is related to U.S. patent application Ser. No. 09/549,088 filed on Apr. 13, 2000 by the same inventor entitled "Spear Blade Swim Fin," the entirety of which is incorporated herein by this reference thereto. This is a divisional application of U.S. patent application Ser. No. 09/549,089 in the name of the same inventor entitled SWIM FIN HAVING ARTICULATED WING MEMBERS filed on Apr. 13, 2000.

BACKGROUND OF THE INVENTION

1. Field of the Invention

This invention relates to swim fins and more particularly swim fins of an advanced design that will allow canceling vortices and better propulsion.

2. Description of the Related Art

With the advancement of scuba diving and snorkeling, swim fins have likewise developed in order to propel the diver through the water. As with the swimming fins of fish, swim fins for human beings have certain dynamic characteristics that provide for different types of propulsion through the water.

The analogy with fish and aquatic mammal fins is particularly apropos, as such fish fins serve to propel fish ranging in size from the smallest minnow to the largest whale. Additionally, if the rules of natural selection are assumed, the development of fish fins for particular activities serves as an indication of advantageous architecture to be adopted in diving fins.

Different species of fish and fish living in different environments have adapted over the thousands of generations to both interspecies and intraspecie competition so that those fish with the most efficient or better fin configuration, geometry, or architecture have a better advantage with respect to other members of their species not so endowed. Over time, advantageous characteristic features are adopted while detrimental or disadvantageous features are eliminated, as individual members of the species compete against one another. As fish are especially adapted for swimming and living in aquatic environments, the arrangement, structure, and architecture of the fins, particularly the fins used for propulsion, are a significant element to the fish's anatomy and its ability to compete and survive with respect to other members of the species.

Ichthyologists characterize fish in a number of ways according to their body type and habitat. Some fish live generally at the surface of the water, others at the bottom, some around coral reefs, and some are deep water, pelagic, fish that are generally in a constant state of motion and generally always swimming. The rear propulsion, or tail, fin of the fish is known as the caudal fin, and may take a number of forms. These include a rounded caudal fin, a truncate caudal fin, a forked caudal fin, and a lunate caudal fin.

Fish with truncate or rounded caudal fins are usually strong swimmers, but are generally slow. Apparently, such truncate or rounded caudal fins provide strength but not speed to the propulsive force of the fish while swimming due to the greater centralized surface area of such caudal fins. Fish with forked caudal fins are generally those that continuously swim. An example of such fish are sharks, which, having no swim bladder, must continually swim in order to maintain their buoyancy. In some sharks, the top fork of the forked caudal fin is elongated to increase the upward force on the fish to hold its vertical position in the water as it swims. Fish with lunate caudal fins tend to be the fastest fish, with such fish being able to maintain relatively high speeds for long durations. Such fish include tuna, mackerel, and jacks, which have a fusiform shape and are generally the fastest fish in the ocean.

Beyond the specific construction of fish fins, fish also have the ability to bring their musculature to bear upon the instant geometry of their fins. Thus, it is an advantage not yet realized in the art to provide a swim fin that allows the diver to adjust the pitch and tension of the diver's swim fin blade, regardless of the specific geometry of the swim fin blade. Furthermore, the art of swim fins would be enhanced and expanded by the ready substitution of one adjustable swim fin blade by another, both swim fin blades being adjustable in pitch and tension.

Most bladed swim fins, particularly those often used in conjunction with scuba and skin diving, are bladed fins having a pair of rails extending outwardly from a foot pocket. Webbing is present in the form of elastic or plastic webbing that forms a blade by which the diver propels him- or herself. Such swim fins often resemble the rounded or truncate caudal fins present on fish. Consequently, such swim fins provide strength, but generally not speed. As a result, skin and scuba divers swimming around reefs and trying to cover longer distances in calm waters must generally work harder in order to propel themselves faster. Additionally, such bladed swim fins are not adjustable, the lateral rails and the blade webbing not providing any adjustment with respect to the foot pocket or adjustment with respect to the pitch and/or tension of the swim fin blade.

By taking advantage of the development in fish fins nature has achieved, a swimmer or diver could better propel him- or herself by adopting a swim fin blade configuration that allows for greater speed and easier propulsion. Additionally, by improving upon present-day swim fins, greater adjustability and tailoring of fin blade performance would allow divers to conform fin blade operation to the diver's preferences.

SUMMARY OF THE INVENTION

The present invention provides swim fins with adjustable wing members having a greater degree of forkedness or lunateness such as that which is often found with the caudal fins of faster-swimming fish. The individual wing members are selectably adjustable by means of a clock or timing washer so that the attitude or disposition of the individual wing members may be selectively positioned with respect to the foot pocket.

In an alternative embodiment, the webbing between the laterally extended rails of the swim fin blade may be discontinuous down its center, thereby allowing water flow in between the two halves of the swim fin blade. In a preferred embodiment, such webbing is continuous and adjustable according to the adjustment of extended rails.

Opposite and opposing vortices may be generated as by the forked or lunate caudal fins of faster swimming fish. Such discontinuity allows the passage of water through the blade of the fin and generally forces the fin to transmit propulsive power rearward, not dispersing it laterally. The lateral dispersion of the swim kick energy generally is not desired by the swimmer, as it does nothing to propel him or her forward. Attitude in the swimmer is generally controlled by shifting the direction of the propulsive power of the swim fins. By concentrating such power rearwardly, the swimmer gets more distance per kick and can travel faster and better through the water.

Alternatively, a cross-connected embodiment of the individual wing member embodiment may be achieved to deliver particular operating performance in the adjustable flexion of the fin.

In the present invention, the blade member(s) are rotatably attached to the foot pocket by clock washers or otherwise. Such rotatable adjustment provides for the adjustment of the pitch, tension, stiffness and/or orientation of the blade/hydrofoil portion of the fin and the effect of the blade/hydrofoil upon the flow of water about it.

OBJECTS OF THE INVENTION

It is an object of the present invention to provide a swim fin having articulated wing members.

It is another object of the present invention to provide a swim fin that provides greater propulsive force.

It is yet another object of the present invention to provide a swim fin that provides better rearward thrust.

It is yet another object of the present invention to provide a swim fin that is adjustable.

It is another object of the present invention to provide a swim fin with fin blades that are adjustable in tension, pitch, geometry, or a combination of each.

It is yet another object of the present invention to provide a swim fin with an interchangeable swim fin blade that is adjustable in its pitch, its tension, and its geometry.

It is yet another object of the present invention to provide a swim fin that generates vortices advantageously.

It is yet another object of the present invention to provide a swim fin that concentrates the swim kick energy into propulsive force.

It is yet another object of the present invention to provide a swim fin that uses available materials and is readily manufacturable.

It is yet another object of the present invention to provide a swim fin with blade adjustment features so as to provide a more versatile and useful swim fin.

These and other objects of and advantages of the present invention will be apparent from a review of the following specification and accompanying drawings.

DESCRIPTION OF THE PREFERRED EMBODIMENT(S)

The detailed description set forth below in connection with the appended drawings is intended as a description of presently preferred embodiments of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

Figure 1:
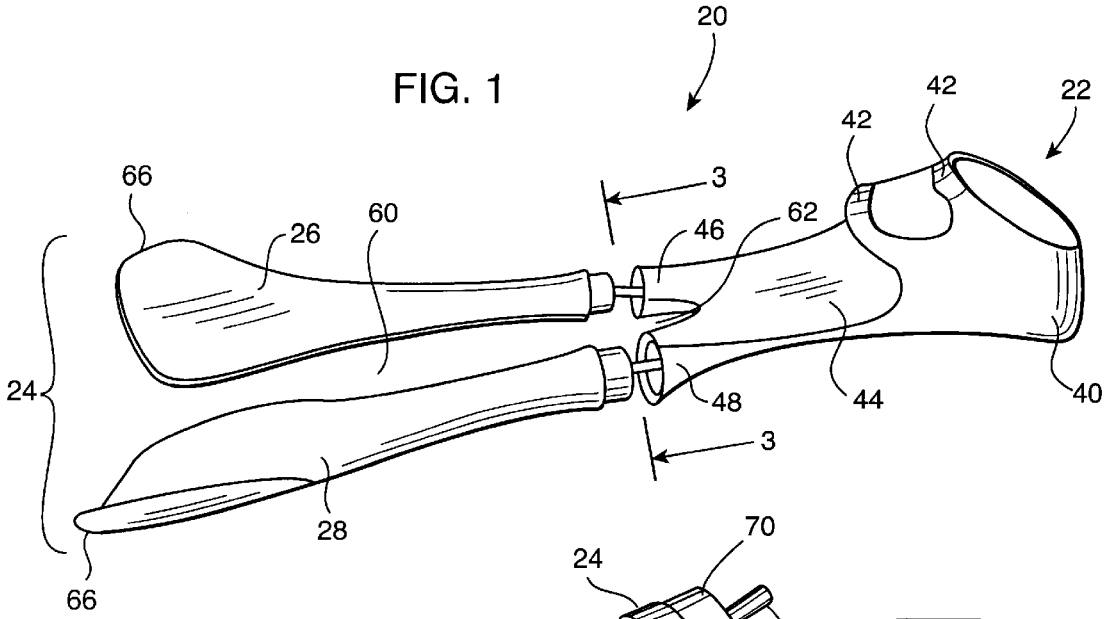
FIG. 1 is an upper left perspective view of the swim fin having articulated wing members of the present invention, the wing members shown in exploded view away from the foot pocket.

As shown in FIG. 1, the swim fin 20 having articulated wing members of the present invention has a foot pocket 22 to which the articulating wing members 24 are attached. The right articulating wing member 26 may be flared outwardly, as may be the left articulating wing member 28. Consequently, both the right and left articulating wing members 26, 28 flare outwardly to provide a forked or lunate propulsion form, thereby creating more advantageous operation by the swim fin 20.

Figure 4:
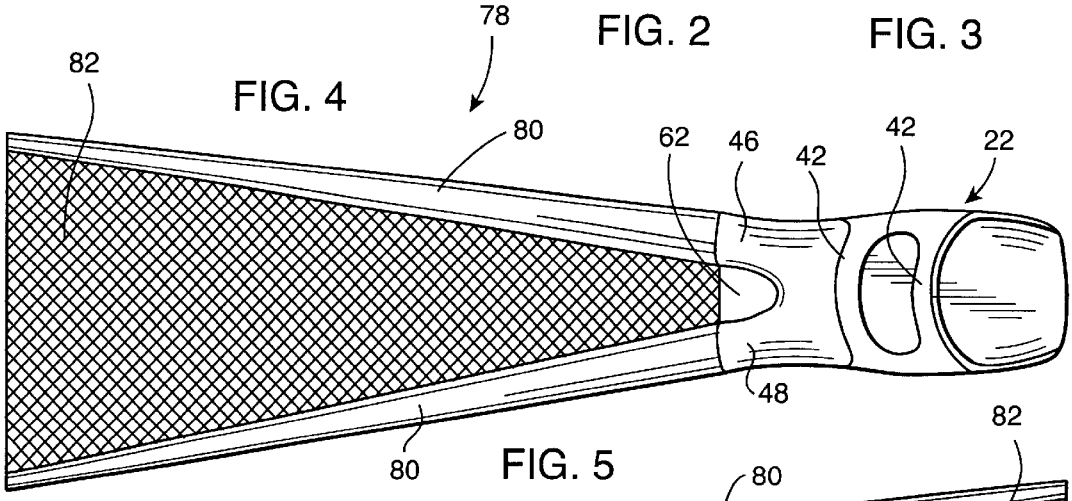
FIG. 4 is a top plan view of an alternative embodiment of the present invention with a continuous blade.

The foot pocket 22 may have a heel cup 40 or may entrap the ankle as by a strap and a pair of transverse spanning members 42. An open-ended heel form requiring a strap is shown in FIG. 4.

The foot pocket 22 has a foot platform 44 upon which the sole of the foot may rest. As shown in the Figures, the foot platform 44 extends both inwardly into the open or close-ended heel cup 40 and outward towards the right and left fork extension stubs 46, 48, respectively. However, the forked nature of the foot pocket 22 is but one embodiment that may be achieved in the present invention. Other foot pocket configurations may be achieved using alternative embodiments, or configurations, of the foot pocket 22 without departing from the present invention. One such embodiment may include a blunt, as opposed to a forked, end. Triangular, circular, square, and other geometries may be achieved without departing from the present invention. When such alternative embodiments are put into practice, the right and left fork extension stubs 46, 48 may become right and left rotational attachment points for foils, wings, winglets, or blades, or other rotatable and/or tensionable extensions from the foot pocket 22.

Figure 5:
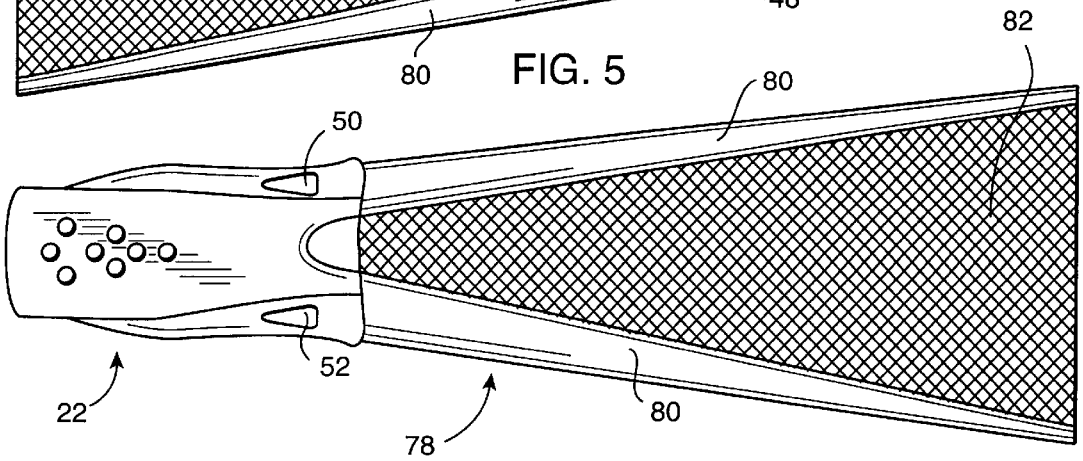
FIG. 5 is a bottom plan view of the swim fin shown in FIG. 4 with the continuous blade.
Figure 6:
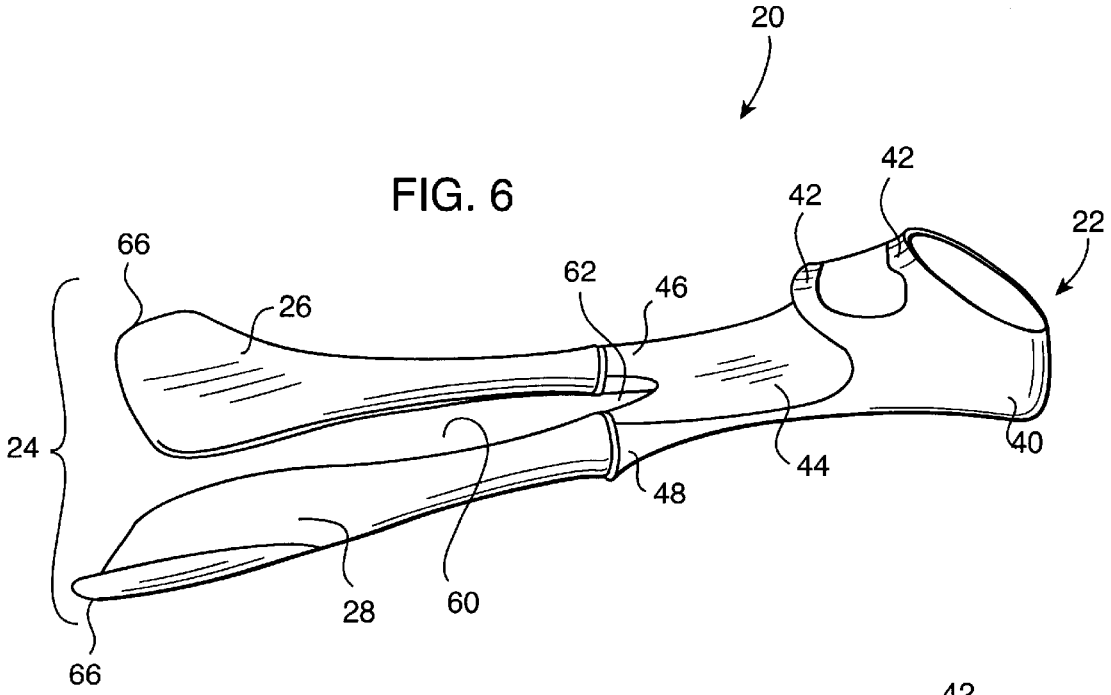
FIG. 6 is a left side perspective view of the swim fin of FIG. 1 showing the articulated wing members attached to the foot pocket.
Figure 7:
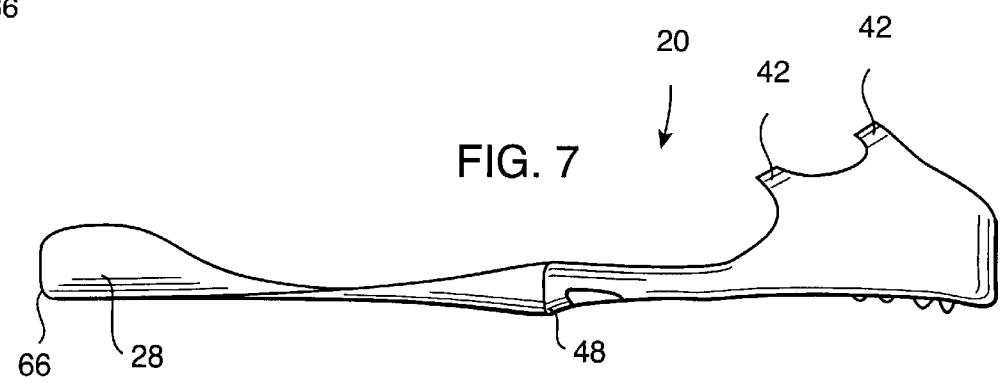
FIG. 7 is a left side elevational view of the swim fin of FIG. 6 with the right view being a mirror image thereof.
Figure 8:
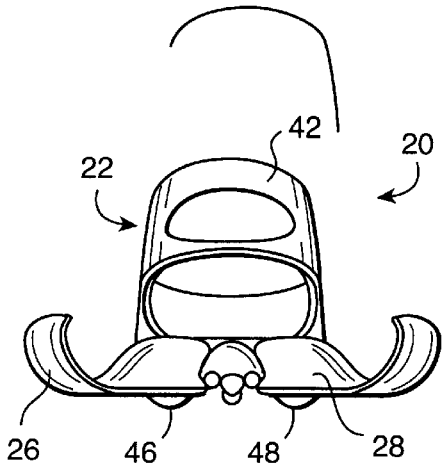
FIG. 8 is a front elevational view of the swim fin of FIG. 6.
Figure 9:
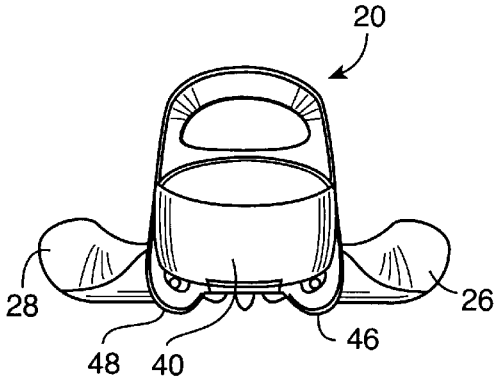
FIG. 9 is a rear elevational view of the swim fin of FIG. 6.

The underside of the foot pocket 22 is generally the same for the several embodiments of the swim fin 20. As seen in FIG. 5, the underside of the foot pocket 22 has right and left indentations 50, 52, where a bolt head, nut, or other fastening device may be used to adjustably attach the associated articulating wing member or extending rail.

As shown in FIG. 1, each of the articulating wing members 24 extend away from the foot pocket 22 in a narrow manner defining a gap or opening 60 between them. The foot pocket 22 enhances this interwing gap 60 by supplying its own foot pocket indentation 62. The edge of the fin as it transitions from the foot pocket 22 to the articulating wing members 24 is generally smooth. While the articulating wing members 24 may have a flat surface configuration, the turning of one or more of the articulating wing members 24 upon the bolts 64 may serve to misalign the surfaces of the articulating wing members 24 and the foot pocket 22. The degree to which the transition between the two surfaces is not smooth is generally minimal. As most of the action or thrust from the swim fin 20 occurs at the ends or tips 66 of the wings 24, the effect of any discontinuities in the transition from the foot pocket 22 to the articulating wing members 24 is generally minimized.

Figure 2:
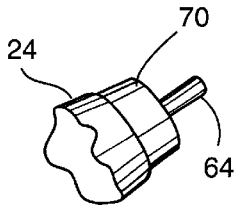
FIG. 2 is a left side perspective view of the clock or timing washer connection with an extending threaded bolt shown at the base of each of the articulating wing members.
Figure 3:
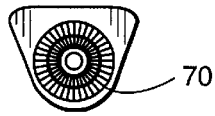
FIG. 3 is a plan view of the clock washer attachment portion of each of the wing members, as taken generally along line 3—3 of FIG. 1.

As shown in FIGS. 1–3, the articulating wing members 24 are held in place by the oppositely-opposed clock or timing washers 70. The clock washers 70 are generally circular washers that are radially-ridged, such that two (2) opposing clock washers 70 mesh, with the teeth of one clock washer fitting into the grooves of the other. Once such clock washers 70 are held in place as by a fixed bolt 64 or the like, the inter-engagement of the teeth of the clock washers 70 prevent any axial or circular motion about the clock washers 70.

Despite the interlocking of the clock washers 70, loosening of the bolt 64 serves to allow the clock washers 70 to space apart from one another, allowing turning upon the bolt 64 and re-engagement of the clock washer teeth. A new disposition for the associated articulating wing member 24 is attained and may be fixed in place by tightening any nut attached to the bolt 64 or by securely threading the bolt 64 into the articulating wing member 24. Although the clock washers 70 prevent certain angles of adjustment from being attained as they would require two (2) teeth to rest upon one another (a half-way turn of the clock washers 70), this is seen and contemplated as only a minor inconvenience, as an angle close to a preferred one can be attained.

Additionally, those of ordinary skill in the art will perceive that a larger number of teeth present in the clock washers 70 will provide greater angular resolution. While friction alone may hold a wing foil 24 in position with respect to the foot pocket 22, use of clock washers 70 is currently contemplated as being more reliable. Such reliability is particularly noticeable when the blade foil 24 is subject to higher pressures and torques. Where a friction connection between the wing foil 24 and the foot pocket 22 might slip, the obstructing ridges of the clock washers 70 preserve the chosen adjustment for each wing member 24.

Any number of effective means may be used in the place of the bolts 64 in order to fix the opposing clock washers 70 together and the articulating wing members 24 to the foot pocket 22. A spring-loaded pin that may or may not allow interchanging of blades could be used to bias the wing member 24 against the foot pocket 22. Also, a peg-and-snap method cold be used where a peg resiliently snaps into a receiving aperture to articulably, but selectively, hold the articulating wing member 24 to the foot pocket 22.

As shown in FIG. 1, the articulating wing members 24 flare outwardly and upwardly at their terminal end 66. The articulating wing members 24 both flare outwardly on either side at the terminal end 66, partially diminishing the gap 60 between them. The articulating wing members 24 also flare upwardly at their outside end. This upward flare serves to guide the water as it flows past the terminal end 66 of the articulating wing member 24. In so guiding the water flowing past it, the articulating wing member 24 may create vortices or otherwise guide the energy of the swim kick in a propulsive, rather than a dispersive, manner. Generally, the vortices created by the individual articulating wing members 24 would have a tendency to rotate in opposite directions, possibly canceling each other out. This may provide enhanced propulsion or, additionally, less turbulence and more propulsive action from the operation of the swim fin 20.

The gap 60 generally allows the flow of water through it, water that would not normally be guided and would be disturbed by a fully-bladed fin. The gap 60 may generally avoid dispersive action of the swim kick, causing the energy to be transmitted along the articulating wing members 24 and used for more propulsive activity.

Due to the nature of the swim fin with articulated wing members 20 of the present invention, greater performance may be achieved through the swim fin; such performance also enhanced by the ability to articulate the individual articulating wing members 24 with respect to the foot pocket 22.

By articulating the right and/or left articulating wing members 26, 28, the diver may control the effect of the swim fin 20 upon the surrounding water and generally the propulsive characteristics of the swim fin 20. Such an additional adjustable advantage provided by the present invention may serve to allow divers to better control their attitude and/or propulsion, particularly for underwater camera work, industrial diving, and the like.

The ability to change the pitch of each wing member, or foil, 24 or their relationship to one another, gives the ability to change the way in which the foils react to one another. It also allows changes in the way in which they work with the water.

Figure 10:
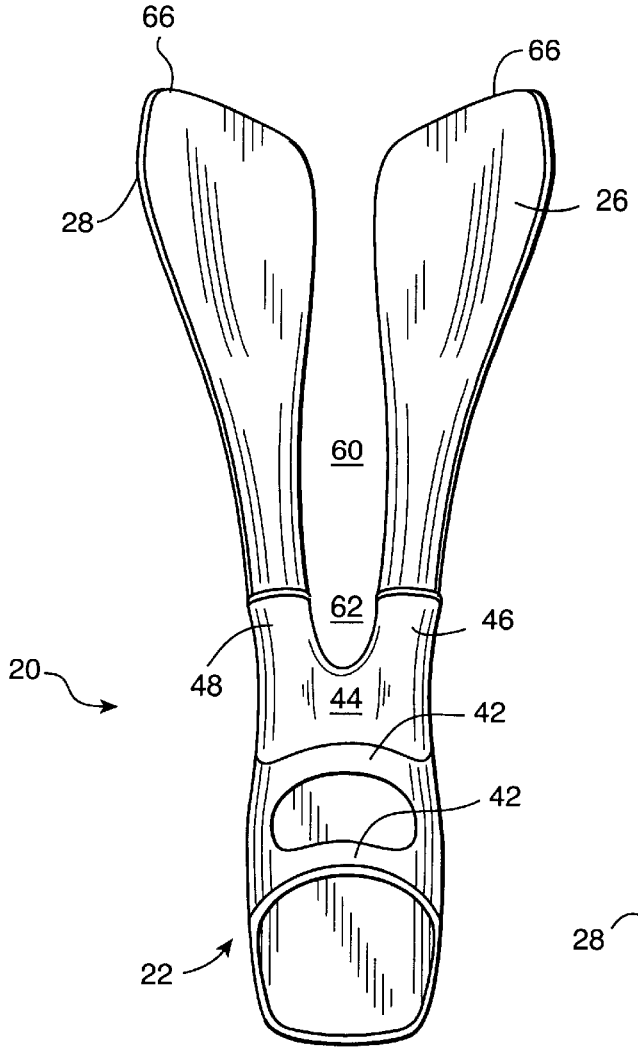
FIG. 10 is a top plan view of the swim fin of FIG. 6.
Figure 11:
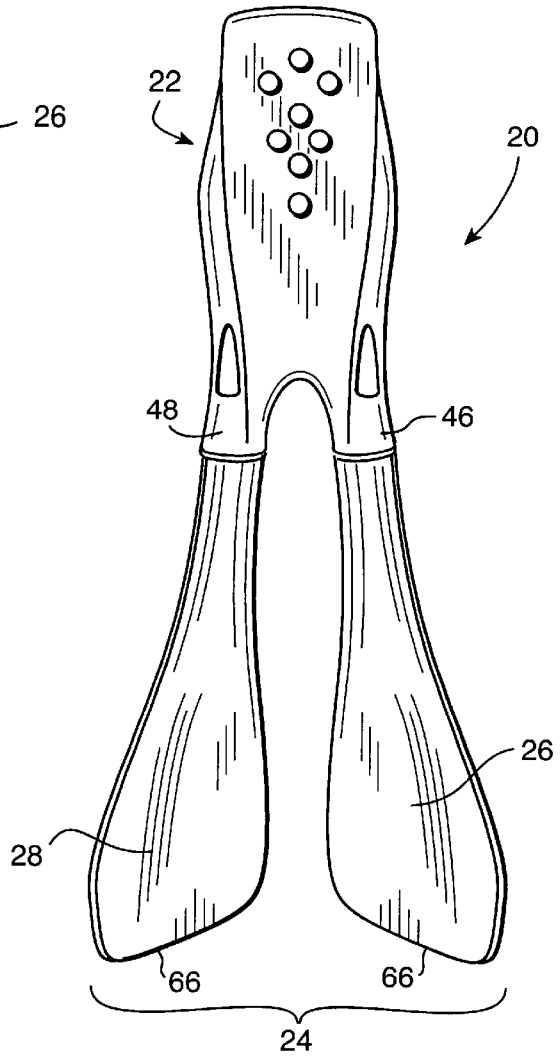
FIG. 11 is a bottom plan view of the swim fin of FIG. 6.
Figure 12:
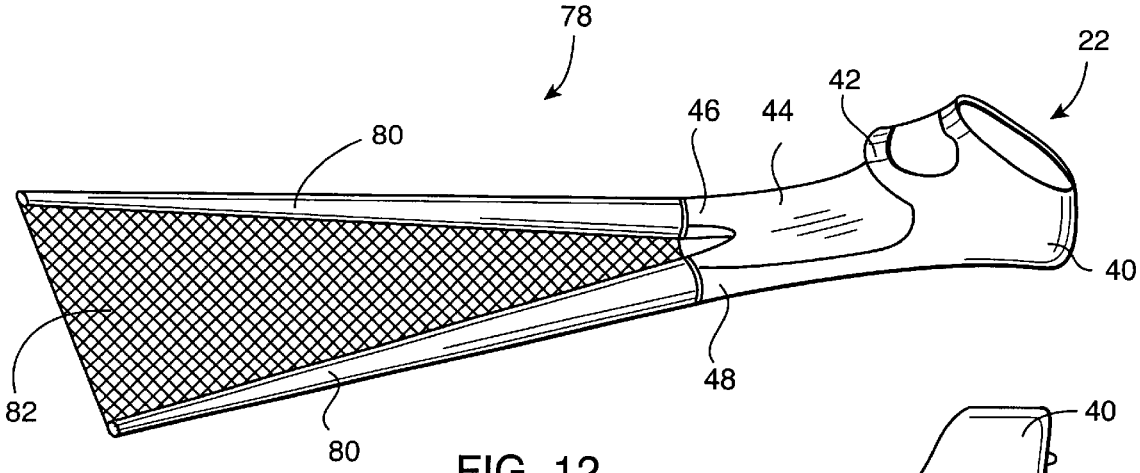
FIG. 12 is a left side perspective view of the swim fin shown in FIGS. 4 and 5.
Figure 13:
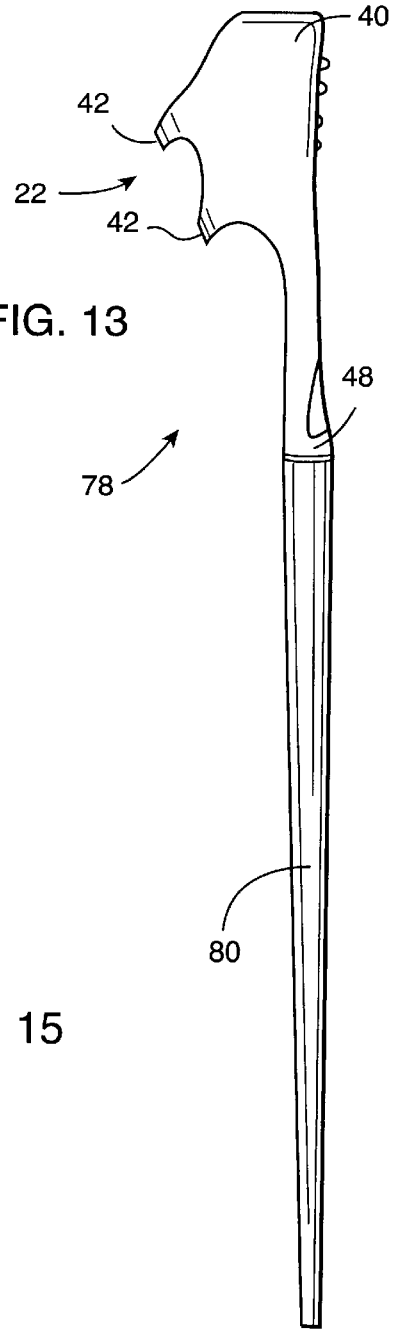
FIG. 13 is a left side elevational view of the swim fin of FIG. 12 with the right side being a mirror image thereof.
Figure 14:
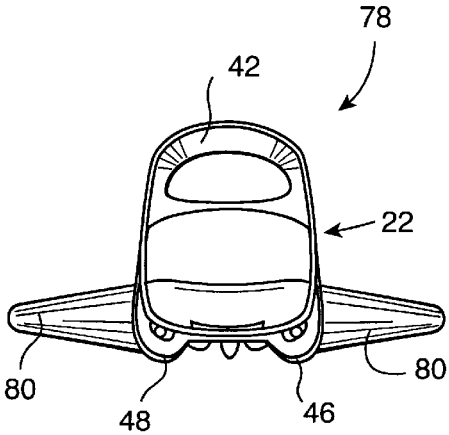
FIG. 14 is a rear elevational view of the swim fin of FIG. 12.
Figure 15:
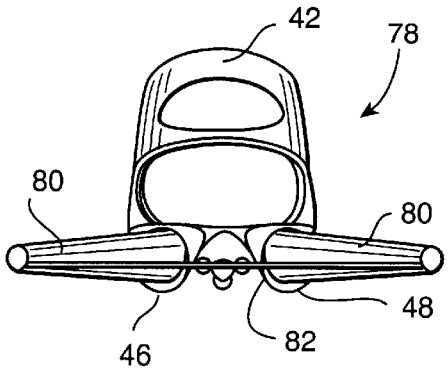
FIG. 15 is a front elevational view of the swim fin of FIG. 12.
Figure 16:
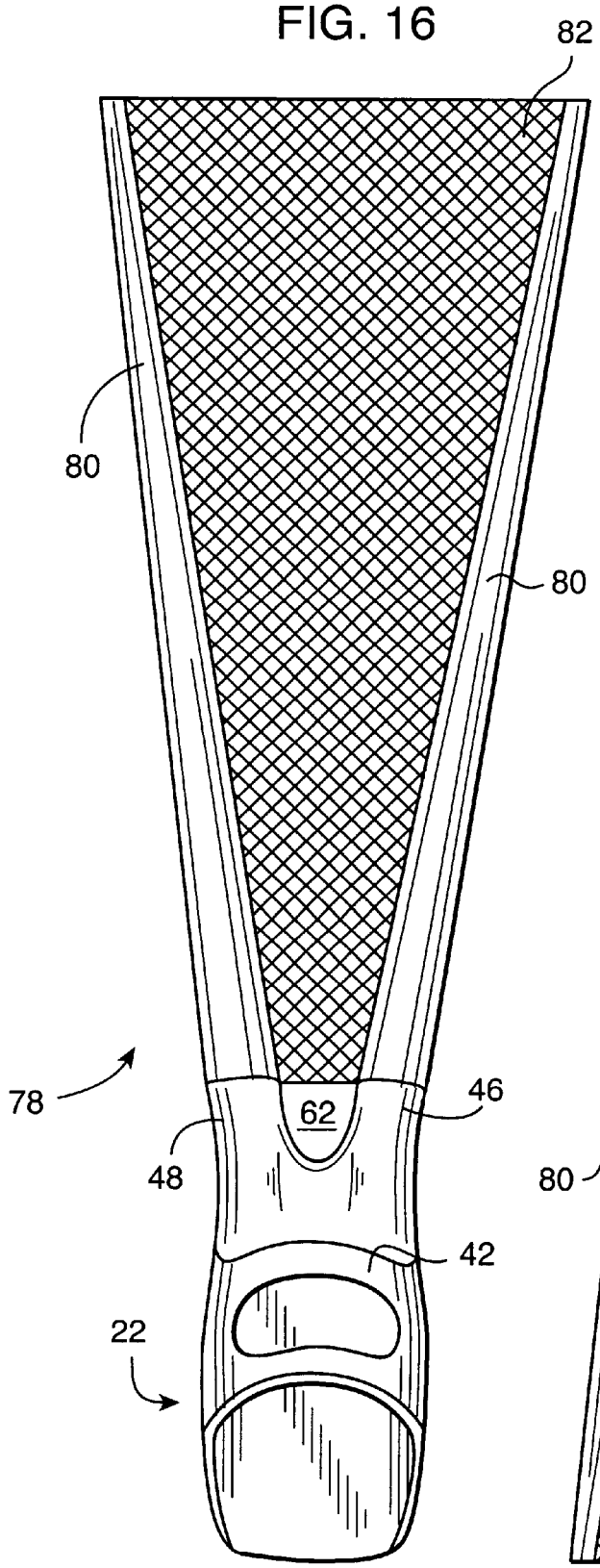
FIG. 16 is a top plan view of the swim fin of FIG. 12.
Figure 17:
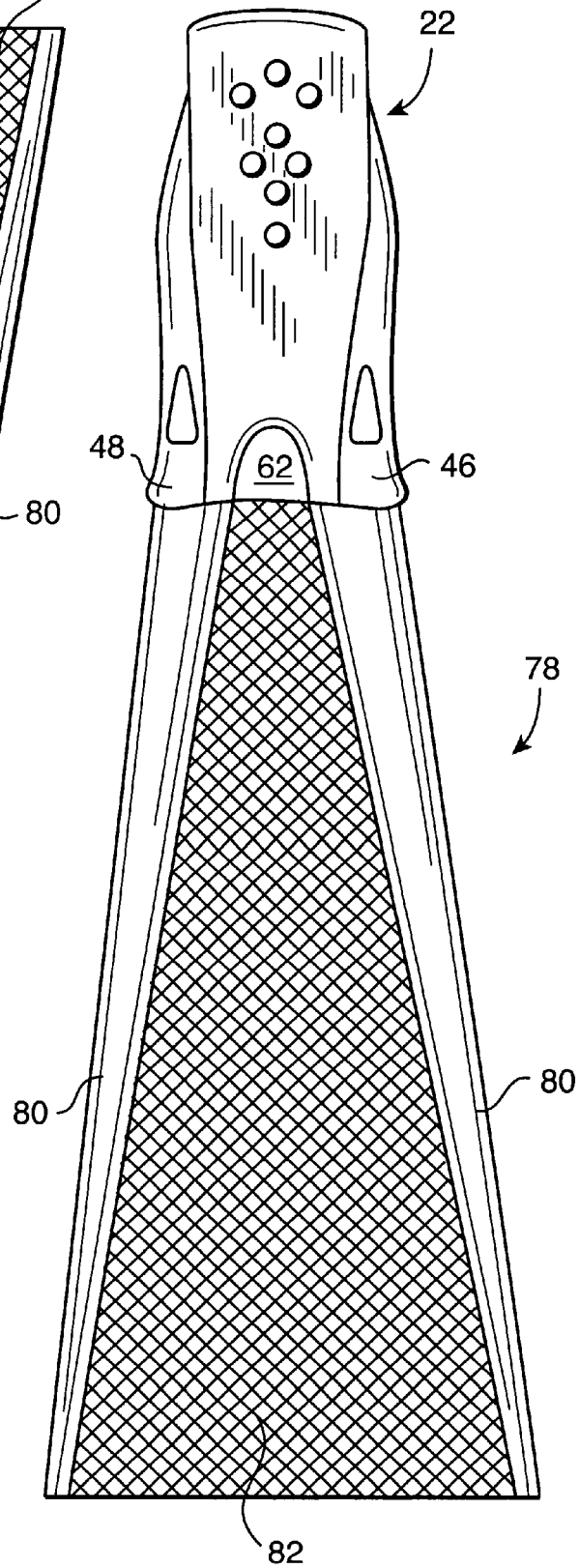
FIG. 17 is a bottom plan view of the swim fin of FIG. 12.

For example, when the foils 24 are oriented so that the center edges are parallel to one another (as shown in the Figures), then they are urged back and outward when a force is exerted upon the upper edge (FIG. 10). When the force is lifted, as when the forward kicking motion is completed, the foils abruptly snap forward and the outer edges travel inwardly so as to accelerate and draw water behind them.

This is consistent with the flaring of the wing foils 24. The foils 24 move outward with forward motion of the foot as the surrounding water presses against the flared ends 74 of the foils 24. With the rearward travel of the foot that occurs during the back kick, the resistance offered by the surrounding water against the flared ends 74 causes the foils 24 to move towards one another, reducing the gap 60 between the individual wing foils 24.

The same embodiment as that shown in FIGS. 1–3 and 6–11 can be changed by rotating one foil so that it is at an angle relative to the other foil. In this configuration, an area of more acute low pressure is created on the lee surface of one foil relative to the other foil. This pressure difference draws the other foil in, so that the foils 24 cross over and under one another in a scissors-like manner. When the force exerted upon the foils ceases, as when the forward kicking motion is completed, the foils 24 abruptly pull away from one another creating low pressure between the foils that draws water from the leading outer edge into the center of is the trailing edge.

The same fin can be changed so that the angle of the V-shaped channel is either more or less acute. When the angle is less acute (wider), the blades 24 are easier to move through the water, but exert less force. When the angle is more acute, the fins exert more force as the blades 24 exert a more effective cross section against the surrounding water.

Additionally, the configuration of the fin 20 can be changed by rotating the foils 24 in a direction opposite to one another. In this case, one foil will be convex on the attacking surface and the other foil will be concave. The relationship between the two foils 24 will draw the concave foil over the convex foil, and when the force is lifted they will abruptly reverse direction, with the concave foil traveling faster than the convex foil. The concave foil is drawn into the low pressure area on the concave side of the convex foil. The resulting action causes the two foils to rotate back and forth over and under one another to impart a propeller-like circular motion at the trailing edge of the hydrofoil 26, 28.

An alternative embodiment of the swim fin 20 of the present invention is shown in FIGS. 4 and 5. The foot pocket 22 is generally the same. However, laterally extending rails 80 are present, as generally true for a regular swim fin. Webbing 82 is present between the rails 80 and forms a somewhat rounded and truncated end. The webbing 82 may be made of generally thinner material than is normally used in standard swim fin blades. The webbing 82 may be reinforced by cross-threads or the like to enhance stability or stiffness.

The rails 80 may be attached to the fork stubs 46, 48 in a manner similar to that as described above for each of the individual articulating wing members 24.

As shown in FIG. 5, the underside of the foot pocket 22 may have a series of protuberances or protrusions 100. These protuberances generate vortices in the form of micro-vortices and serve to accelerate the flow of water about the fin, particularly the foot pocket 22.

In sustaining the same articulating features as the wing foils 24 (FIG. 1), the extending rails 80 allow the diver to adjust the tensions and stiffness on the webbing 82. By tensioning the webbing 82, less flexing of the webbing 82 occurs between each kick. If the extending rails 80 are adjusted to provide more slack in the webbing 82, more flexing of the webbing 82 occurs during the transition from one kick direction to the other. If elastic types of webbing are used, such tension adjustments will alter the performance of the webbed fin 78 shown in FIGS. 4 and 5.

In an alternative embodiment, the webbing 82 may be separated at its middle so as to allow two (2) individual web panels to pivot or flap about their corresponding rails 80. When the diver uses the swim fin 20, water then passes through the gap between the two (2) webbing panels. When the swim fin 20 works against the water, the web panels flex. In so flexing, the gap between the panels widens, allowing more water to pass through the gap.

The base of the webbing may be constructed without a separation to prevent the full articulation of the individual panels at the base. By limiting the angle through which the individual right and left web panels may flex, or flap, water is allowed to flow through the gap between the panels while the panels exert some propulsive force arising from the surface of the webbing 82 pressing against the water during the swim kick.

Figure 18:
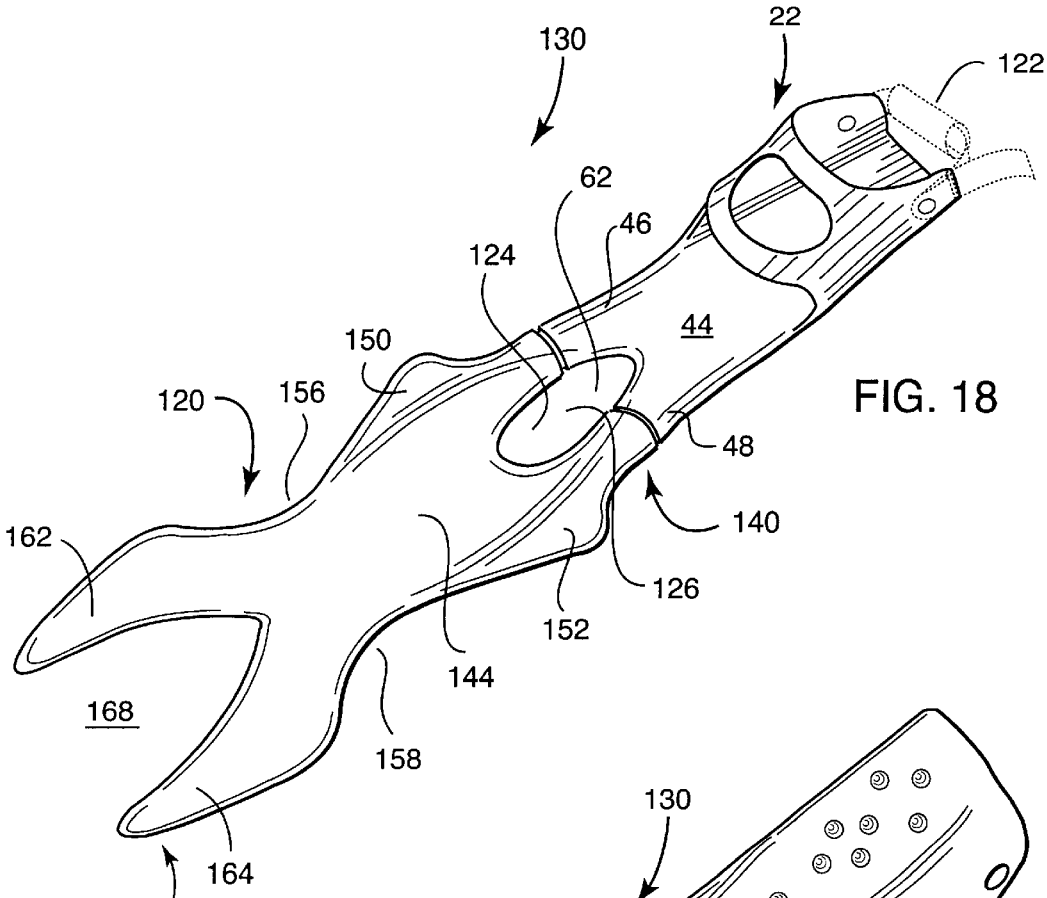
FIG. 18 shows a top perspective view of an alternative embodiment of the swim fin of FIG. 1 having cross-connected wing members.

As shown in FIGS. 18–26, an alternative embodiment of the present invention exists in attaching a cross-connected thin blade member 120 to the foot pocket 22 as is present in the other embodiments of the present invention. The foot pocket 22 (as shown in FIG. 18) is an open foot pocket, and a heel strap 122 is shown in phantom in FIG. 18. Such heel straps 122 serve as means by which the foot may be held inside the foot pocket 22 when the foot pocket 22 is of open construction.

As shown in the Figures, the foot pocket's indentation 62 is complemented by a generally similar indentation in the cross-connected blade member 120. The corresponding indentation 124 in the cross-connected blade member forms an aperture 126 in the swim fin 130 as a whole.

As travel is made from the foot pocket 22, particularly from the right and left fork extension stubs 46, 48 to the distal end 142, a number of features arise that create the unique performance characteristics for the cross-connected swim fin blade 120.

Figure 19:
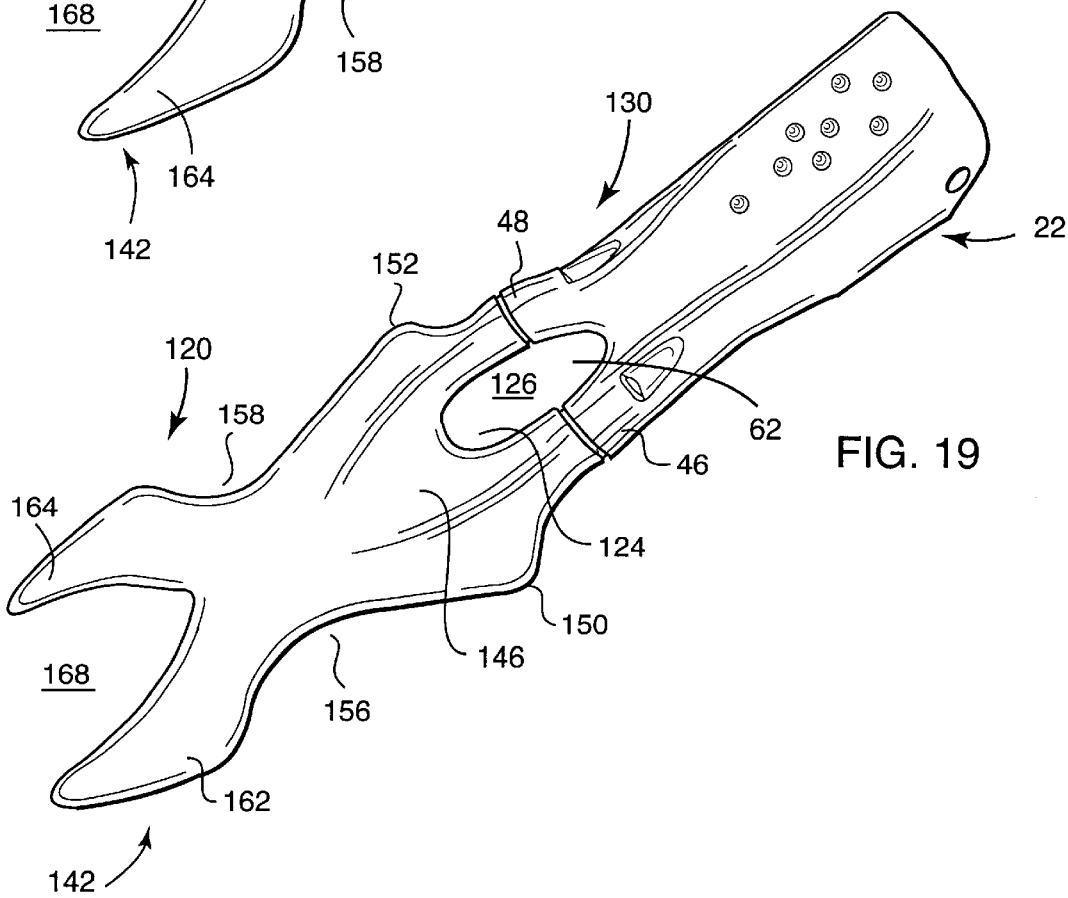
FIG. 19 is a bottom right side perspective view of the swim fin of FIG. 18.
Figure 20:
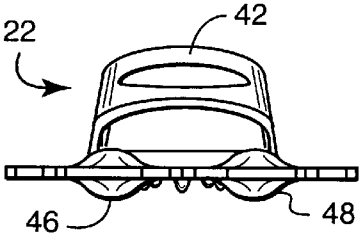
FIG. 20 is a front elevational view of the swim fin of FIG. 18.
Figure 21:
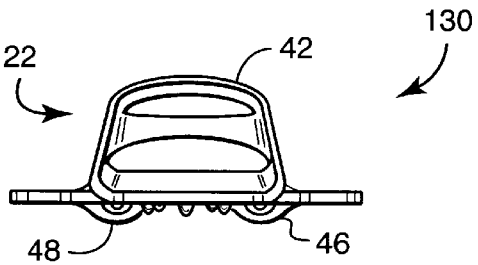
FIG. 21 is a rear elevational view of the swim fin of FIG. 18.
Figure 22:
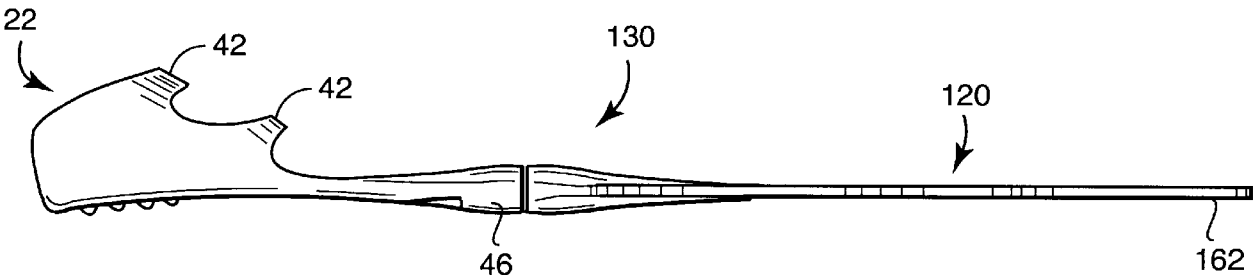
FIG. 22 is a right side elevational view of the swim fin of FIG. 18.
Figure 23:
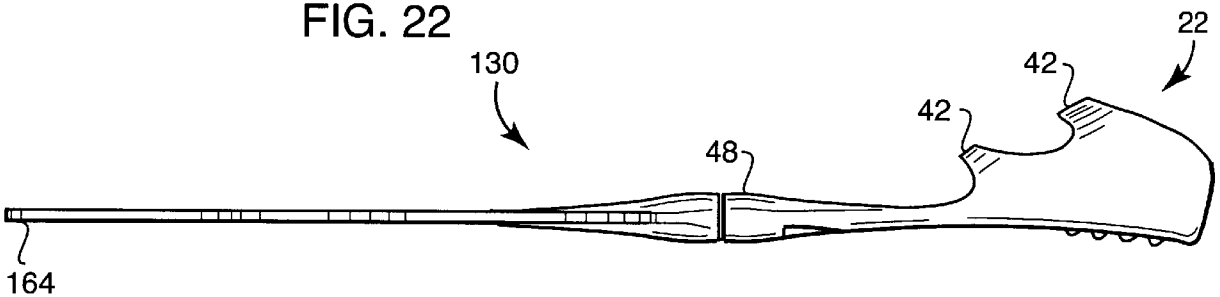
FIG. 23 is a left side elevational view of the swim fin of FIG. 18.
Figure 24:
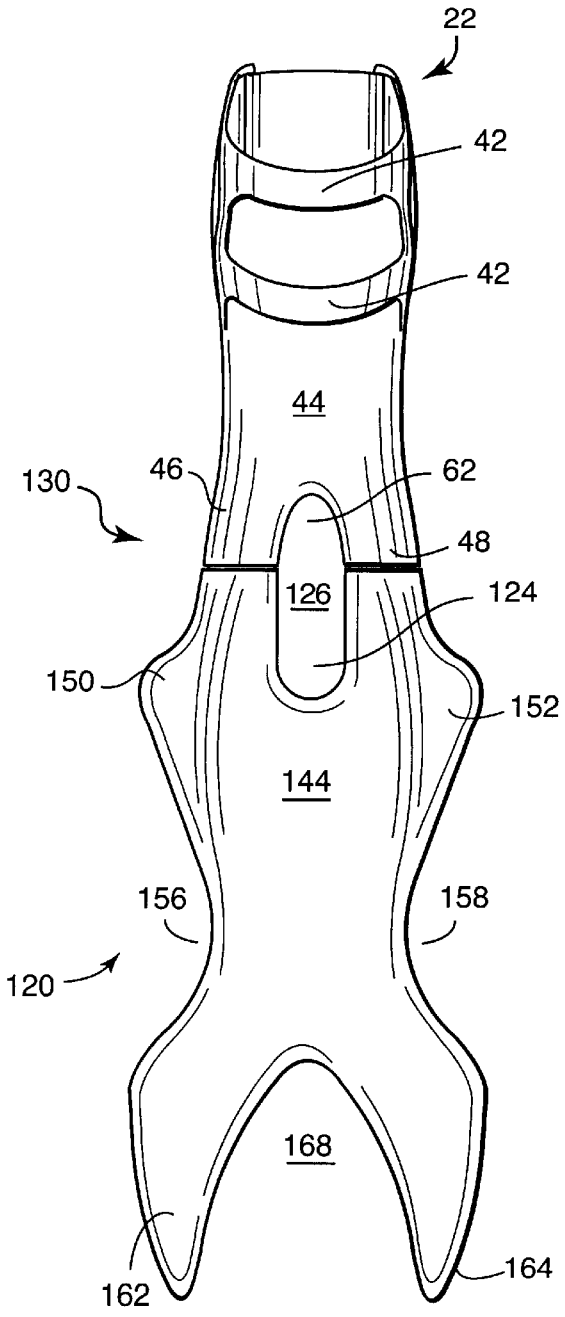
FIG. 24 is a top plan view of the swim fin of FIG. 18.
Figure 25:
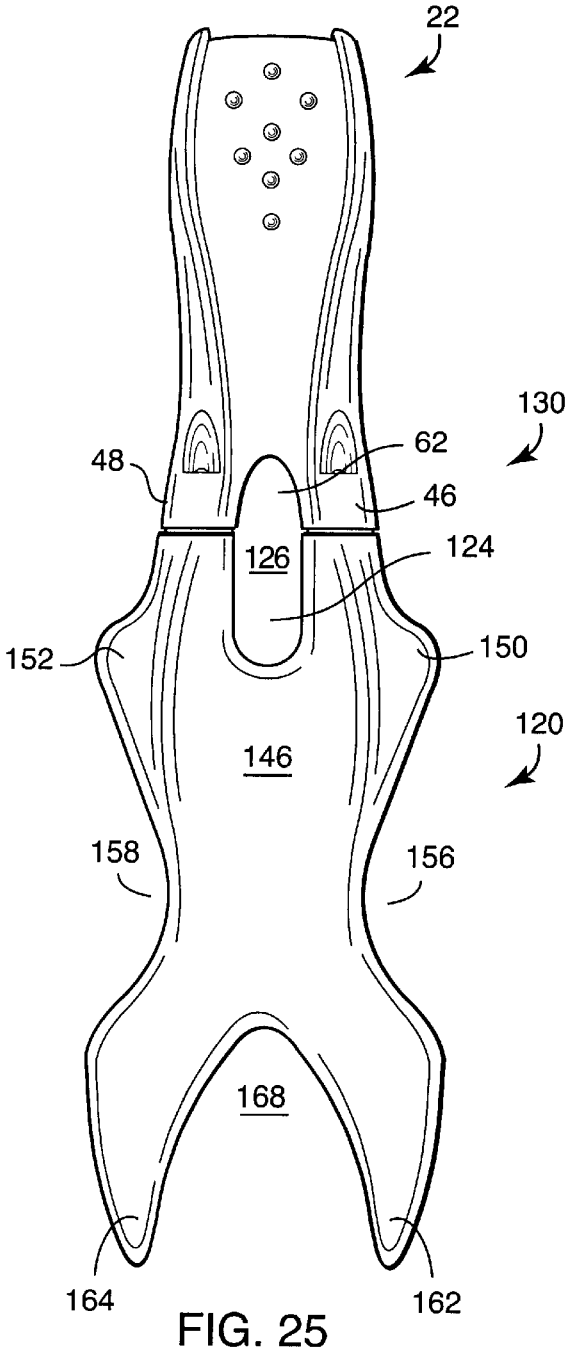
FIG. 25 is a bottom plan view of the swim fin of FIG. 18.
Figure 26:
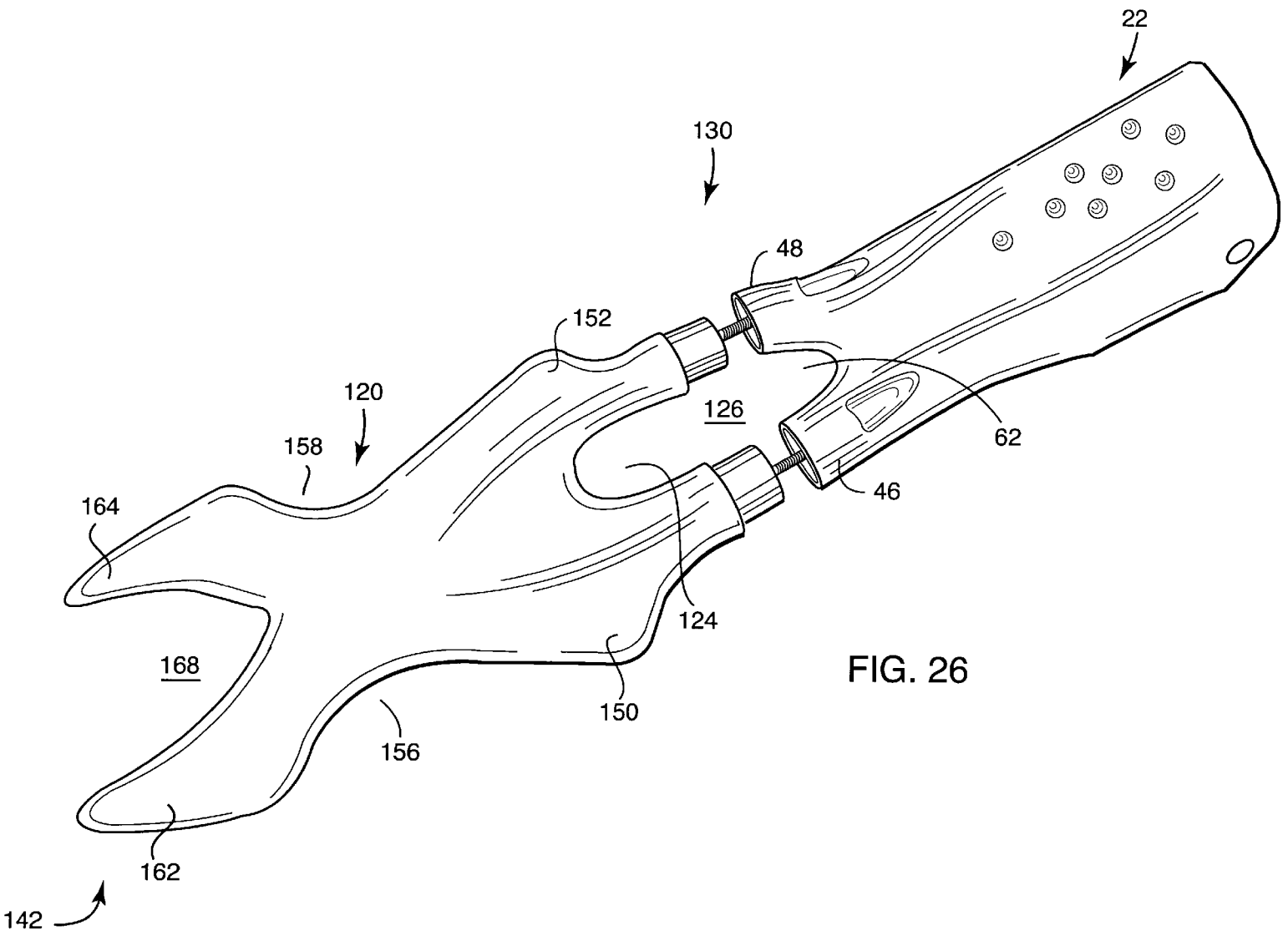
FIG. 26 is a right side bottom perspective view of the swim fin of FIG. 18, showing in an exploded view the cross-connected blade member separated from the foot pocket.

As travel is made from the base of the cross-connected swim fin blade 120 to its end 142, variations on the surface and perimeter of the swim fin blade provide the structural characteristics necessary in order to achieve the controlled flow of water about it during the diver's swimming kick. To be noted is an indentation or depression 144 forward of the aperture 126. As shown in FIG. 19, the depression 144 on the top side of the swim fin 130 (FIG. 18) gives rise to an upwelling or rise 146 on the bottom side of the swim fin 130 (FIG. 19). The depression side of the swim fin allows channeling of the water through the aperture 126, while the upwelling 146 may create an area of low pressure that serves to draw the water through the aperture 126. Additionally, the flow of water through the aperture 126 may serve to create flow across the bottom of the swim fin 130. This water flow reduces the presence of dead areas and allows more efficient propulsion and control from the use of the swim fin.

Referring now to FIG. 18, travel from the base 140 to the end 142 of the swim fin blade 120 shows left and right symmetry about the center of the swim fin blade 120. In extending outward from the fork extension stubs 46, 48, the swim fin blade 120 flares outwardly to a significant, but not extreme, degree via the minor flares 150, 152. The flares then give way to oppositely-opposed indentations 156, 158 which are made more noticeable by the prominent fin extensions 162, 164 at the end 142 of the swim fin blade 120. A gap 168 is present between the two swim fin extensions 162, 164.

Overall, the swim fin blade 120 may resemble or operate as the body of a fish having a caudal fin similar to that of the right and left swim fin extensions 162, 164. The minor flares 150, 152 may generally correspond to the dorsal and pelvic fins of such a fish. The right and left fin extensions 162, 164 at the end 142 of the swim fin blade 120 represent a forked caudal fin often found with fishes that swim continuously. Such a forked fin may provide a good compromise between the lunate caudal fin structure and the rounded or truncated caudal fin structure. While providing a cross-section that is taller vertically (for a fish with a forked caudal fin), a forked caudal fin structure present in the swim fin blade 120 may provide a compromise between the power available with stubbier fins versus the speed over long distances available through a lunate fin structure.

Presence of the right and left indentations 156, 158 may provide additional flow channels for water flowing past the swim fin blade 120. These channels (including the fin separation gap 168 between the right and left fin extensions 162, 164 as well as the aperture 26), may reduce the presence of dead areas around the swim fin blade 120. Such dead areas may increase the effective inertia of the swim fin blade 20, reducing its efficiency for propulsive purposes.

As for the other embodiments of the present invention, the cross-connected swim fin blade 120 of the present invention may be articulated about the clock washer 70. This may tense or bow the cross-connected swim fin blade 120 with respect to the foot pocket 22. By so controlling the geometry of the cross-connected swim fin blade 120, the operating characteristics may be altered according to the preferences of the diver.

Figure 27:
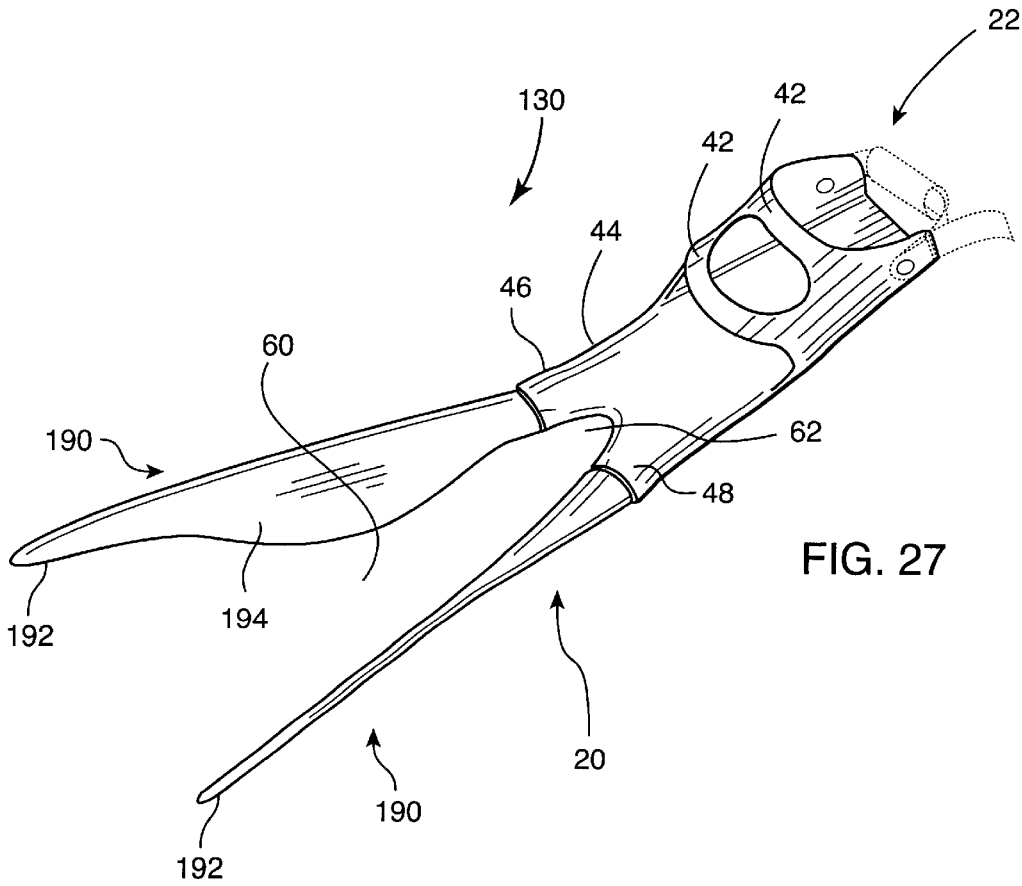
FIG. 27 is a left-side perspective view of an alternative embodiment of the present invention having wing members centrally and inwardly lobed with distal elongate extension.
Figure 28:
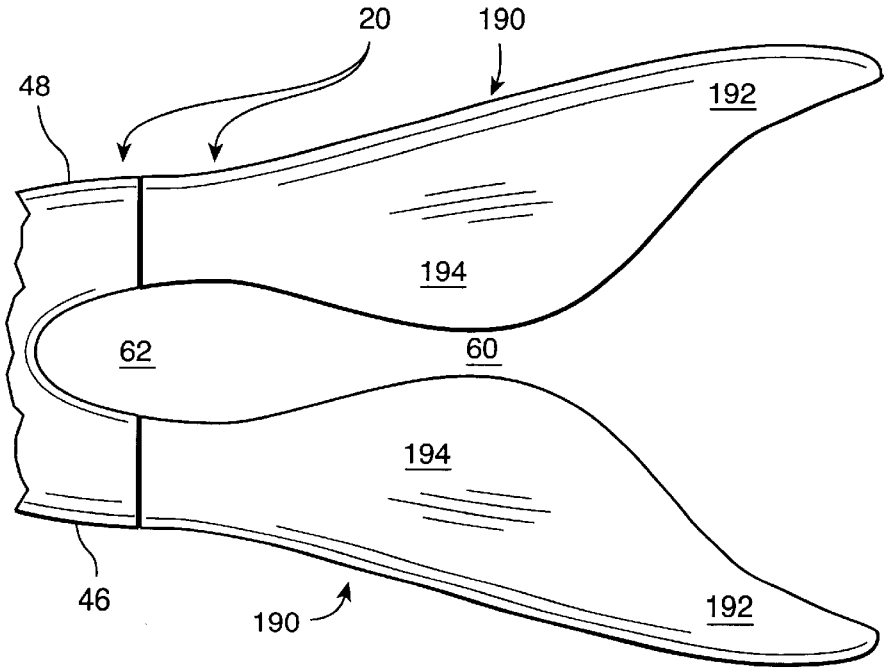
FIG. 28 is a top plan view of the swim fin of FIG. 27, the top wing tilted to the plane of the page.

As shown in FIGS. 27 and 28, an alternative embodiment of the present invention is present in the use of wing members having lobed fins with the lobes inwardly extending at the middle portion of the wing. The wing also has distal elongate extensions extending outwardly from the main portion of the wing.

The wing members 190 are mirror images of each other and articulate upon the right 46 and left 48 fork extension stubs in the same way as wing members 26, 28 do for the embodiment shown in FIG. 1. Each of the wing members has a convex and protruding middle section 194 that leads into a tapered, projecting extension 192 at the end of the wing member 190. As can be seen from the figures, particularly FIG. 28, the interwing gap 60 and foot pocket indentation 62 remain present. The interwing gap 60 is adjustable such that the flow of water between the wing members 190, as well as the pressure on the lobes 194, can be adjusted by articulating or turning the wing members 190 and the fork extension stubs 46, 48.

The adjustable operation of the centrally-lobed wing members 190 depends upon the angle at which the lobes 194 make with respect to the overall plane of the swim fin 20 (generally as defined by the plane of the foot platform 44).

When the lobes are turned so they are off the plane of the swim fin 20, they articulate differently with respect to the motion of the foot. For example, when scuba divers swim along a reef, they generally have an up-and-down foot motion used to propel themselves by means of their swim fins. If the wing members 190 are turned such that the lobes 194 project towards is the bottom of the swim fin (generally in an upward direction as the diver is swimming), then the following flow pattern occurs.

As the diver moves the foot downwardly, water is able to more easily travel through the interwing gap 60 as the wings 190 have a tendency to flex slightly and in so doing this allows the lobes 194 to move outwardly, increasing the cross-section of the interwing gap 60 and allowing more water to flow therethrough. Conversely, when the diver moves the swim fin upwardly, the flexing of the wings 190 serves to urge the lobes 194 together. This decreases the cross-section or flow area of the interwing gap 60 and prevents water from more easily flowing through the interwing gap 60.

In association with the articulation of the wing members 190 and the lobes 194, the effective cross-section of the wings 190 operates inversely with respect to the interwing gap 60. That is to say, when water more easily flows through the interwing gap 60, the wing members 190 provide less action against the water and less propulsion. However, when the interwing gap 60 diminishes (as for the back kick, above), then the wing members 190 generally operate against the water more effectively as less water flows past them and more water is engaged by them.

As for the other embodiments of the present invention, by selectably turning the lobed wing members 190 in the fork stubs 46, 48, a diver can selectively control the operation of the swim fin by controlling the attitude or disposition of the wing members 190.

As for other aquatic paraphernalia, the lobed wing members 190 may be made of a variety of materials. Preferably, flexible polymers able to withstand a marine environment are preferred.

While the present invention has been described with regards to particular embodiments, it is recognized that additional variations of the present invention may be devised without departing from the inventive concept.

What is claimed is:

1. A swim fin having adjustable wing members, comprising:

a foot pocket for receiving a foot;

a first rotational attachment point defined on said foot pocket forward of said foot pocket;

a second rotational attachment point coupled to said foot pocket; and, first and second wing members separated one from the other by a gap, said first and second wing members each coupled to said foot pocket forward of said foot pocket via said first and second rotational attachment points, respectively, and each having a long axis about which said first and second wing members may independently rotate; whereby;

thrust provided by the swim fin via said first and second wing members may be made adjustable by selectably rotating said first and second wing members with respect to said first and second rotational attachment points, respectively.

2. The swim fin having adjustable wing members as set forth in claim 1, wherein said foot pocket includes a heel cup.

3. The swim fin having adjustable wing members as set forth in claim 1, further comprising a heel strap.

4. The swim fin having adjustable wing members as set forth in claim 1, wherein said second rotational attachment point is defined on said foot pocket, said second wing member fitting to said second rotational attachment point.

5. The swim fin having adjustable wing members as set forth in claim 1, wherein said first and second wing members include inwardly flared middle portions, said first and second wing members being mirror images of each other.

* * * * *